US005683137A

United States Patent [19]

McDonald et al.

[11] Patent Number: 5,683,137

[45] Date of Patent: Nov. 4, 1997

[54] TIME-OUT CHAIR/SEAT

[75] Inventors: Thomas B. McDonald; Martin S. Cregg; Scott W. Osiecki, all of Skaneateles, N.Y.

[73] Assignee: Bright Ideas Group, Inc., Skaneateles, N.Y.

[21] Appl. No.: 649,770

[22] Filed: May 15, 1996

[51] Int. Cl.[6] ..... A47C 7/62

[52] U.S. Cl. ..... 297/217.3; 297/188.1; 297/217.4; 297/188.09; 297/188.11; 297/188.12; 297/440.16; 368/76

[58] Field of Search ..... 297/217.4, 217.3, 297/188.01, 188.11, 188.12, 188.1, 188.14, 440.16, 188.09; 368/107, 108, 109, 76; 40/493, 495, 501

[56] References Cited

U.S. PATENT DOCUMENTS

| | | | |
|---|---|---|---|
| 2,544,896 | 3/1951 | Niditch et al. | 297/188.1 X |
| 2,813,575 | 11/1957 | Bode | 297/440.16 |
| 3,230,006 | 1/1966 | Sokolis | 297/188.1 |
| 4,038,561 | 7/1977 | Lorenz | 307/141 |
| 4,161,098 | 7/1979 | Ingendahl | 368/76 |
| 4,538,142 | 8/1985 | Hamilton et al. | 297/217.4 |
| 5,044,961 | 9/1991 | Bruskewitz | 368/233 X |
| 5,107,555 | 4/1992 | Thrasher | 5/109 |
| 5,122,994 | 6/1992 | Benedetti | 368/93 |
| 5,182,823 | 2/1993 | Alsip | 4/206 |
| 5,299,178 | 3/1994 | Bilik | 368/76 |
| 5,384,917 | 1/1995 | Epling | 4/235 |

*Primary Examiner*—Peter M. Cuomo
*Assistant Examiner*—Rodney B. White
*Attorney, Agent, or Firm*—Trapani & Molldrem

[57] ABSTRACT

A time-out seat for a child is provided which comprises a seat member configured and dimensioned to accept a child in a sitting position; a structure which supports the seat member in an orientation for sitting and at a predetermined height. A timer is provided for timing a preset time-out period. The timer includes the capabilities of setting a predetermined time-out period, indicating the time remaining in the time-out period, and signaling the end of the time-out period. The timer is supported in a position where a child sitting in the seat can observe the indication of the time remaining in the time-out period. A method of disciplining a child using the time-out seat is also contemplated by the present invention.

20 Claims, 4 Drawing Sheets

TIME-OUT CHAIR/SEAT

BACKGROUND OF THE INVENTION

1. Technical Field

The present invention relates to a child disciplining method called "time-out," and more particularly, to a seat, such as a chair, used in the time-out method.

2. Background Art

A widely known and used method for disciplining a child is referred to as "time-out." In this method, the child requiring discipline is directed to sit quietly on a seat such as, for example, a chair, stool or bench, for a specified period of time. If the child's conduct is satisfactory during the time-out period, the child is allowed to resume normal activities at the end of the period. To be effective, the length of the time-out period is normally set in proportion to the seriousness of the child's misbehavior, the child's age, or to the frequency of continued misbehavior. Thus, monitoring the appropriate time-out period is critical to the success of this disciplinary technique.

Heretofore, parents, teachers and others employing the time-out method have been required to glance at a clock or watch to note the start time of the time-out period, and then to be vigilant as to the passage of time to know when the time-out period has elapsed. In practice, the one administering this method of discipline is distracted from other activities throughout the time-out period. This potential for distraction may discourage the use of the time-out method. Further, if the child being disciplined is not given a sufficient and/or appropriate time-out period, the time-out method of discipline may not be effective. Conversely, if the child is left too long in time-out, this could be considered too harsh and harmful. Thus, there is a need to encourage the use of the theoretically effective time-out method of discipline, and to ensure that it is properly and beneficially administered in practice.

Another difficulty experienced with the time-out method is that the child being disciplined frequently has a strong curiosity to know the time remaining in time-out. This frequently leads to repeated inquiries by the child and increased impatience. The parent or other guardian finds herself or himself responding to the child's inquiries which results in further distraction of the parent or other guardian. Thus, there is a need in the time-out methodology to indicate to the child the commencement, time remaining, and completion of the time-out period.

A stool for use in a time-out procedure is shown in U.S. Pat. No. 4,538,142 to Hamilton et al. The Hamilton et al. patent discloses a stool which includes a seat-actuated signaling mechanism. If a child, once sitting on the stool, gets up during the time-out period, the signaling mechanism will produce an audible signal to alert the parent. A problem with the stool in Hamilton et al. is that the parent must keep track of time during the time-out period. A further problem is that the child has no indication of the time remaining in the time-out period, hence leading to repeated inquiries by the child as to the time remaining. Thus, Hamilton et al. does not solve the aforesaid problems associated with conventional time-out procedures. The need still exists for a time-out seat which provides the child and the parent with an indication of the time-out period, the time remaining in the period, and the expiration of the period.

OBJECTS AND SUMMARY OF THE INVENTION

It is therefore an object of the present invention to overcome the problems associated with the prior art discussed above, and to provide an improved time-out seat.

It is another object of the present invention to provide a time-out seat which encourages the use of the time-out method of discipline,. and ensures that it is properly and beneficially administered in practice.

It is a further object of the present invention to provide a time-out seat which indicates the commencement, time remaining, and expiration of the time-out period.

It is yet another object of the present invention to provide a time-out seat which has means for marking the number of times a child has been required to sit in the time-out seat.

It is yet a further object of the present invention to provide a time-out seat which can convey educational or moral messages to the child during the time-out period.

It is still another object of the present invention to provide a time-out seat which can be adjusted to accommodate different sizes of children.

It is a still further object of the present invention to provide a time-out seat which can also be used to store educational items for use during the time-out period.

These and other objects are obtained in accordance with the present invention wherein there is provided a time-out seat for use in disciplining a child. The seat comprises a seat member configured and dimensioned to accept the child in a sitting position. The seat member is supported by a seat support structure such as, for example, legs or a solid frame. The support structure supports the seat member at a predetermined height and in an orientation for sitting. The seat further comprises a timer for measuring a preset time-out period. The timer can be set for a predetermined time-out period. In addition, the timer constantly indicates the time remaining in the time-out period. Further, the timer indicates or signals the end of the time-out period.

In one embodiment, the present invention takes the form of a child's chair, comprising a generally U-shaped frame which serves as the seat support structure, back and arms of the chair. A seat member is supported by the U-shaped frame. A storage bin may be formed or mounted in the frame, with the seat member disposed over the storage bin. The seat member may be supported, in whole or at least in part, by the storage bin. A timer is mounted to the chair. Preferably, the timer is mounted in a receptacle contained in one arm of the chair. A child record dial may also be mounted in another receptacle contained in the other arm of the chair. The names of children expected to use the chair are recorded on the dial. The names may be recorded on the dial by affixing thereto name plates or decals containing the names. The dial is configured such that the child's name can be selectively displayed when that particular child is occupying the chair. The dial also includes slidable markers for recording the number of time-out periods experienced by each named child.

Other embodiments may employ an electronic display device and a microcomputer to automate the timing, display, and signaling functions. With such embodiments, messages that encourage and reinforce good behavior can be programmed into the computer and displayed to the child during the time-out period.

A method of disciplining a child by placing the child in a time-out seat, for a time-out period, is also contemplated by the present invention. The method comprises the steps of: (1) providing a time-out seat on which the child is to be seated during the time-out period; (2) providing a timer with the seat for timing a preset time-out period, the timer having means for setting a predetermined time-out period, means for timing the time-out period, means for indicating the time remaining in the time-out period, and means for signaling the end of the time-out period; (3) setting a time-out period on the timer as the child is seated in the seat; (4) timing the time-out period with the timer; (5) constantly indicating the time remaining in the time-out period; and (6) signaling the end of the time-out period.

BRIEF DESCRIPTION OF THE DRAWING

Further objects of the present invention will become apparent from the following description of the preferred embodiments with reference to the accompanying drawing, in which.

DESCRIPTION OF THE PREFERRED EMBODIMENTS

Figure 1:
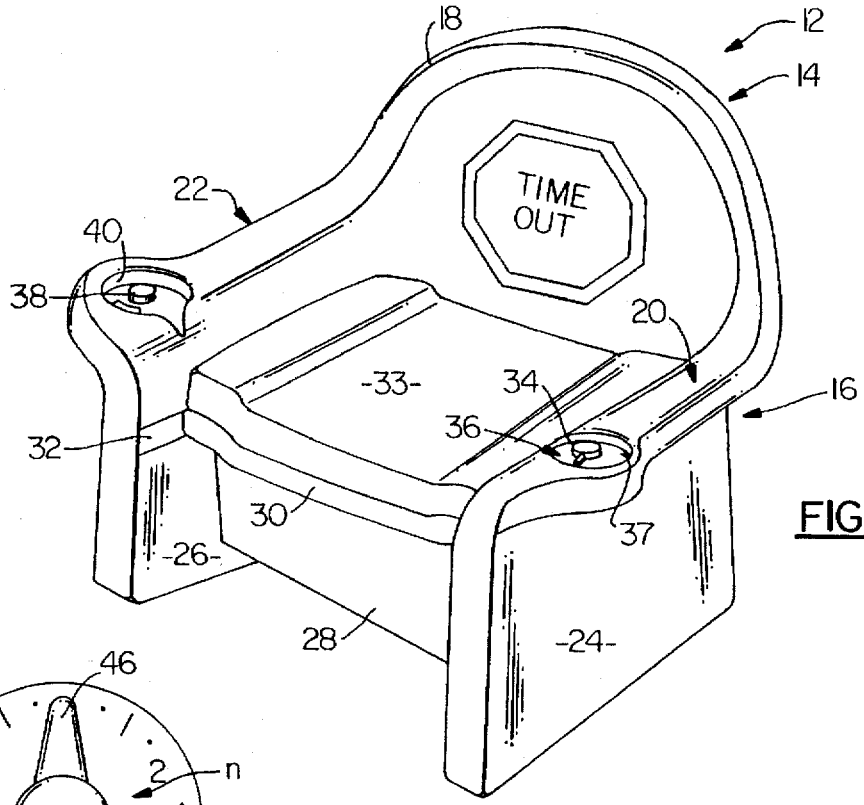
FIG. 1 is a perspective view of one embodiment of the time-out seat of the present invention, configured as a child's chair.

With reference to FIGS. 1–4, there is shown a time-out chair 12 constructed in accordance with the present invention. Time out chair 12 comprises a generally U-shaped frame 14 which includes integrally formed base 16, back support 18, and arm supports 20 and 22. Base 16 includes a pair of upright side walls 24 and 26 to which a storage bin 28 may be removably mounted. As shown in FIG. 1, storage bin 28 has a flange 30 which slidably engages a pair of opposing grooves 32 contained in side walls 24 and 26 respectively. This engagement supports bin 28 in frame 14. Of course, any other suitable means may be employed for mounting bin 28 to frame 14.

With further reference to FIG. 1, chair 12 also includes a seat member 33 configured and dimensioned to accept a child in a sitting position. Seat member 33 is supported by a seat support element or structure which, in the embodiment of FIG. 1, is bin 28 mounted to frame 14. Seat member 33 is supported by bin 28 at a predetermined height and in a substantially level orientation for sitting. Alternatively, seat member 33 may be mounted directly to frame 14 by means of a tongue-and-groove arrangement or by any other known mounting methods. As understood from FIG. 1, seat member 33 can be lifted off bin 28 to gain access to the contents of the bin. Alternatively, bin 28 could be pivotally mounted to frame 14 or bin 28 to allow seat 33 to be lifted up from and lowered down to the opening in bin 28. Frame 14, bin 28, and seat member 33 can all be made from a plastic such as, for example, a fiberglass reinforced polyester.

With further reference to FIG. 1, chair 12 further comprises a timer 34 for measuring a preset time-out period. Timer 34 is configured in a conventional manner, like an egg timer, such that it can be set for a predetermined time-out period. In addition, timer 34 contains a dial face 42 (See FIG. 2) which constantly indicates the time remaining in a time-out period. Further, timer 34 signals the end of the time-out period by some audible alarm or indicating light. If configured like an egg timer, timer 34 would simply contain a bell which is sounded at the end of the pre-set time-out period. As shown in FIG. 1, timer 34 is mounted in a receptacle 36 formed in arm 20. Timer 34 is protected from child tampering by a cover 37 made of a transparent plastic, such as an acrylic, so that the child's view of timer 34 is not impaired. Cover 37 may be configured like a child tamper-resistant bottle cap which can engage a corresponding locking structure associated with receptacle 36, in a manner well known in the art.

Also shown in FIG. 1, is a child record dial 38 mounted in a receptacle 40 which is formed in arm 22. Child record dial 38 provides a means for recording the number of times a particular child has sat through a time-out period in chair 12. The details of dial 38 will be described hereinbelow with reference to FIG. 4. A transparent cover or closure may also be employed to protect dial 38 from child tampering.

Figure 2:
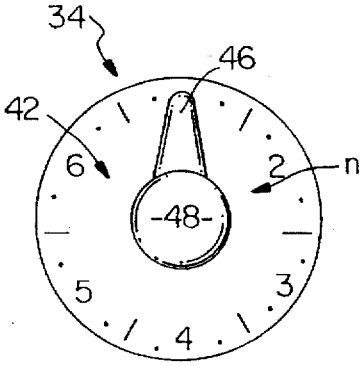
FIG. 2 is a plan view of the timer used in the chair shown in FIG. 1.
Figure 3:
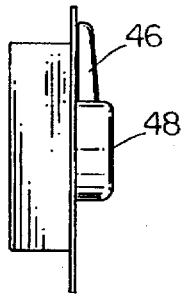
FIG. 3 is a side elevational view of the timer shown in FIG. 2.

As shown in FIG. 2, timer 34 includes a dial face 42 having numerals n thereon designating minutes in a time-out period. A pointer 46 can be moved to a desired setting by means of a knob 48. By turning knob 48, a desired time-out period can be set on timer 34. Once allowed to run, timer 34 measures (or tracks) the pre-set time-out period. Pointer 46, in cooperation with dial face 42, continuously indicates the time remaining in the time-out period.

Timer 34 can be a mechanical timer of a well known type in which a spring (not shown) is wound when knob 48 is manually turned. Upon release of knob 48, the spring discharges stored energy through an escapement mechanism (not shown) to move pointer 46 back to the zero or starting position shown in FIG. 2. In a preferred embodiment of applicant's invention, timer 34 would produce an audible ticking sound which would indicate the passage of time to a child in chair 12. In addition, timer 34 would produce an audible signal, such as a ringing or buzzing sound, at the end of the time-out period. Alternatively, or in addition, a visible indication, such as an LED, may signal the end of the time-out period. Timer 34 can be, for example, a LUX Minute Minder timer, sold by Ekco Mousewares, Inc., Franklin Park, Ill.

Figure 4:
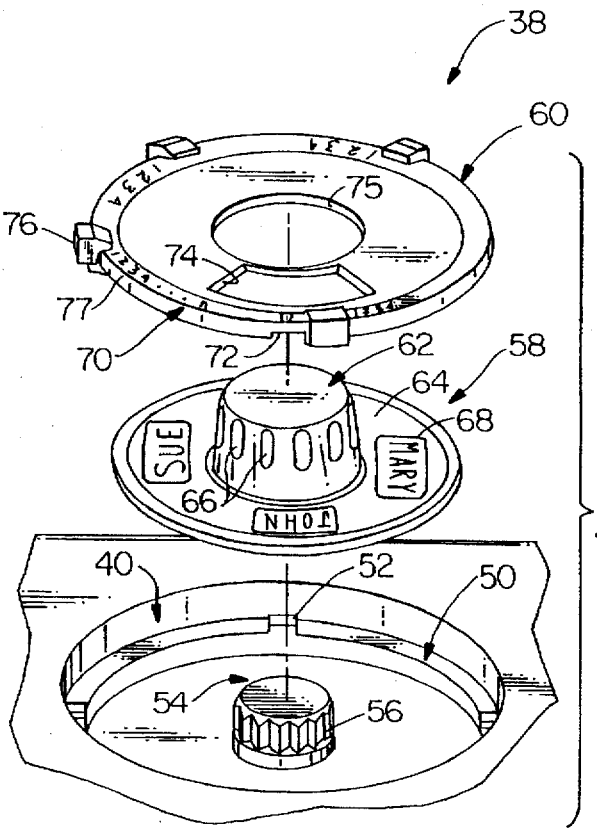
FIG. 4 is an exploded perspective view of the child record dial for the chair shown in FIG. 1.

With reference to FIG. 4, there is shown an exploded perspective view of child record dial 38 and receptacle 40. A circular shoulder 50 is integrally molded and concentrically disposed with the surrounding wall of receptacle 40. Shoulder 50 includes four equally-spaced alignment nubs 52, the functions of which will become apparent hereinbelow. A centrally disposed, cylindrically shaped boss 54 is integrally molded with the bottom surface of receptacle 40. Boss 54 has a plurality of vertically oriented ribs 56 disposed around the cylindrical wall of boss 54.

As shown in FIG. 4, dial 38 comprises a record disk 58 and a display disk 60. As understood by the exploded view of FIG. 4, record disk 58 fits closely into receptacle 40 in concentric relation with shoulder 50. Record disk 58 includes a centrally disposed and protruding knob 62 and an annular record surface 64. Knob 62 contains a plurality of grooves 66 which correspond to ribs 56 on boss 54. Grooves 66 are configured and dimensioned to mate closely with ribs 56. Due to the coefficient of friction between disk 58 and the interior surfaces of receptacle 40, disk 58 can be manually rotated about boss 54 by grasping and turning knob 62. The interaction of ribs 56 and grooves 66 causes disk 58 to be rotated in a stepped fashion to prevent inadvertent rotation after the desired position has been set.

As shown in FIG. 4, record disk 58 contains four equally spaced stickers or decals 68, each one of which contains the printed name of a particular child expected to be using time-out chair 12. In the completed assembly of dial 38, display disk 60 superposes record disk 58 and is fixed against rotation in receptacle 40. Record disk 58 is assembled for rotation in receptacle 40. Disk 60 includes a rim or flange 70 containing four equally spaced slots 72 which correspond to alignment nubs 52 of receptacle 40. Slots 72 mate tightly with nubs 52 to effect a secure removable attachment of disk 60 to receptacle 40. Disk 60 contains a transparent display window 74 through which a recorded identity (or name decal 68) of a particular child can be viewed when the identity (or decal) is aligned with window 74. One of decals 68 is aligned with window 74 by selectively rotating record disk 58 about boss 56. Disk 60 also contains a centrally disposed opening 75 through which knob 62 of record disk 58 projects.

As shown in FIG. 4, four adjustable markers 76 slidably engage rim 70. For each marker 76, there is numeric indicia contained on rim 70, i.e., a set of consecutive numbers 1, 2, 3, 4 . . . n, indicated at 77. Markers 76 are used to mark the number of time-outs a particular child has experienced, up to the number n. Each marker 76 is selectively movable with respect to the numeric indicia, to provide a visual record of the number of time-outs for a particular child.

As understood from FIG. 4, each marker 76 is constrained from moving beyond its respective quadrant (along rim 70) as a result of adjacent alignment nubs 52. In the preferred embodiment, each marker 76 is assigned to a particular child identified on record disk 58. Markers 76 and name decals 68 can be colored with corresponding colors to indicate the assignment of each marker 76 to a particular child name.

When a child is directed to be seated in time-out chair 12, knob 62 is manually turned to rotate disc 58 until that child's name appears through window 74. At this time, the marker corresponding to that child can be moved to the number on rim 70 that matches the number of times that child has sat through a time-out. After dial 38 has been updated for the present time-out occurrence, timer 34 is set to time a predetermined time-out period.

Figure 5:
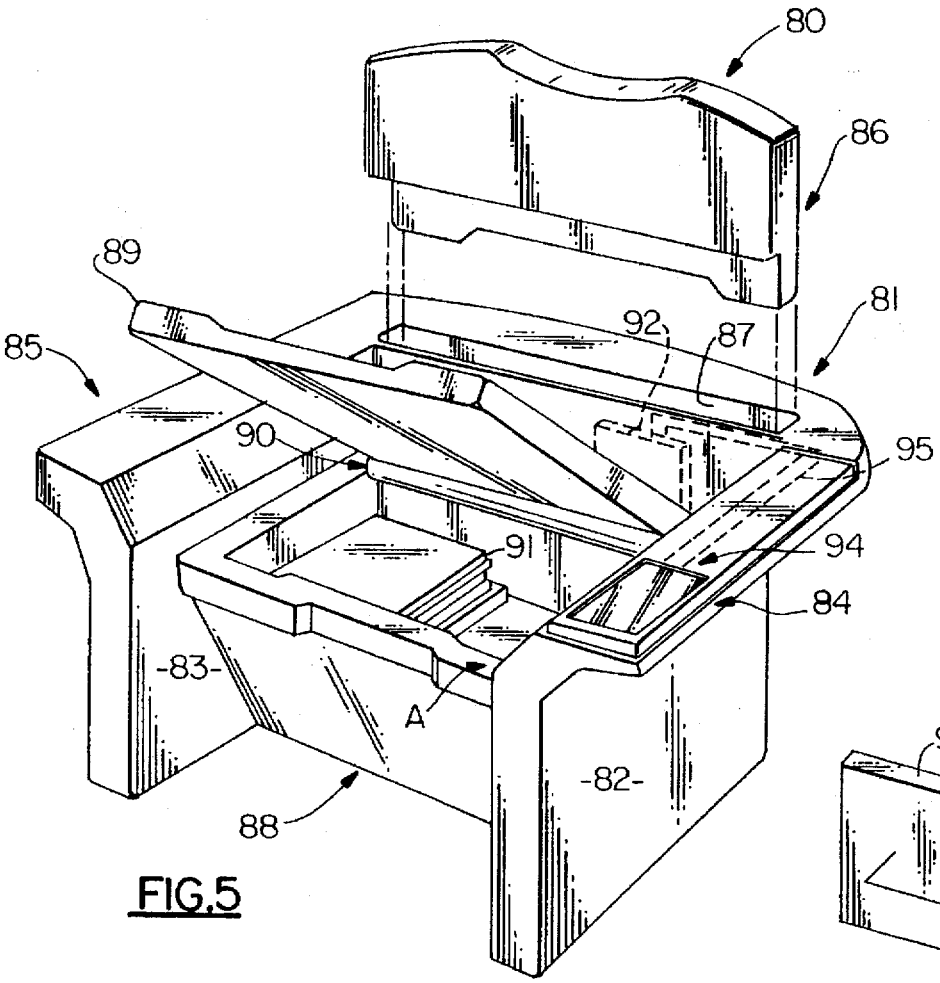
FIG. 5 is a perspective view of a second embodiment of the time-out seat of the present invention, also configured as a chair.
Figure 6:
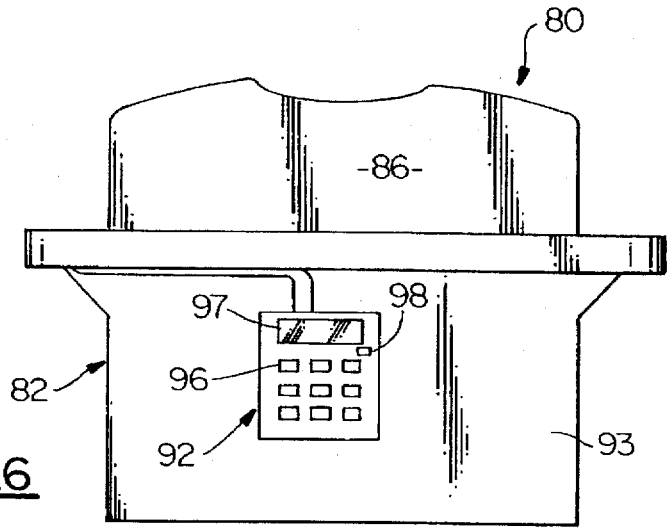
FIG. 6 is a back elevational view of the chair shown in FIG. 5.

Turning now to FIGS. 5 and 6, a second embodiment of applicant's invention is shown. As shown in FIG. 5, a time-out chair 80 comprises a generally U-shaped frame 81 which includes a pair of upright side walls 82 and 83. Extending up and out from side walls 82 and 83 is a pair of arm supports 84 and 85, respectively. A back support piece 86 is removably received and mounted in a rear lateral slot 87 contained in frame 81 (See FIG. 5). Chair 80 also comprises a storage bin 88 which is mounted between side walls 82 and 83 of frame 81. Bin 88 can be secured in frame 81 by an interference fit between side walls 82 and 83, or by, for example, a tongue-and-groove arrangement (not shown). Alternatively, bin 88 can be integrally molded with frame 81.

As shown in FIG. 5, a seat member 89 is pivotally mounted to bin 88 at point 90, and is configured and dimensioned to accept a child in a sitting position. Seat member 89 is supported by a seat support element or structure which, in this embodiment, is bin 88. Bin 88 supports seat member 89 at a predetermined height and in an orientation for sitting. As shown in FIG. 5, bin 88 may contain educational material, such as books 91, which may be required reading for the child during a time-out period. Alternatively, seat member 89 could be supported by frame 81 which would function as the seat support element.

An advantage offered by the construction of chair 80 is that the chair can easily be separated into U-shaped frame 81, back support 86, storage bin 88, and seat member 89. This modular construction makes chair 80 easy to package and ship, easy to handle during use, or easy to store when not in use.

With further reference to FIGS. 5 and 6, chair 80 includes a microcomputer 92 mounted on a back wall 93 of frame 81. As shown in FIG. 5, an electronic display screen 94 is mounted in arm support 84, and connected to microcomputer 92 via power and data cables 95 (shown in phantom lines). As shown in FIG. 6, microcomputer 92 has a keyboard 96 and a small electronic display 97. Keyboard 96 is used to program and operate microcomputer 92. Display 97 provides a means for visually confirming information or selections entered into microcomputer 92 via keyboard 96, and for displaying error messages. As shown in FIG. 6, microcomputer 92 also includes an audible transducer 98, such as a small speaker, which receives electrical signals from microcomputer 92 to produce audible signals including, for example, synthesized voice messages. Alternatively, or in addition thereto, a speaker may be positioned in some other location on chair 80. For example, a speaker could be located adjacent to display 94.

Microcomputer 92 is programmed to function as a timer for measuring a preset time-out period. Microcomputer 92 can be programmed to measure any desired time-out period, and to display via display 94 the time remaining in the time-out period. In addition, microcomputer 92 can be programmed to indicate or signal the end of the time-out period by generating, for example, a tone signal or a voice message out of speaker 98. In the preferred embodiment, microcomputer 92 is programmed such that an operator can set a desired time-out period through keyboard 96. In the preferred embodiment, microcomputer 92 is also programmed to constantly indicate, through display 94 and/or display 97, the time remaining and/or the elapsed time in the time-out period. Further, in the preferred embodiment, microcomputer 92 is programmed to display messages on display 94 which, for example, would encourage good behavior and/or reinforce rules established by a parent or guardian. The messages would be displayed on display 94 during the time-out period.

Microcomputer 92 may also be programmed to store the time-out history of each child using chair 80. For example, the number of time-out periods and the duration of each such time-out period may be stored in a memory in microcomputer 92. The time-out history data may be accessed upon the entry of a password or security code.

Figure 5A:
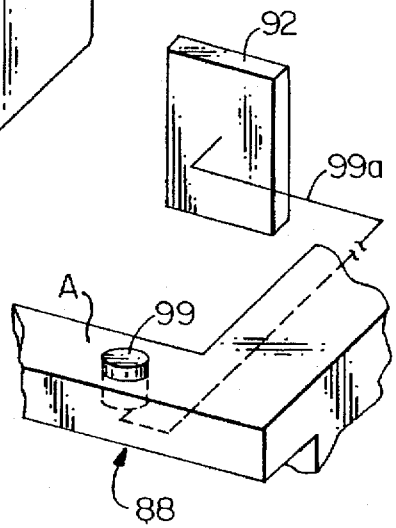
FIG. 5A is an enlarged fragmented, perspective view of a modification to the second embodiment.

In a modification to the embodiments of the present invention, the timer or timing function is controlled, in part, by whether or not a child is seated in the time-out chair. In this modification, the timer would start timing a pre-set time-out period when the child first sits down on the time-out chair, and would suspend timing if the child leaves the chair. This modification employs means for sensing the condition that a child is seated on the seat member of the time-out seat, and means for initiating the timing function of the timer. FIG. 5A shows this modification implemented in the second embodiment. It is to be understood, however, that this modification is not limited to a computer implementation.

As shown in FIG. 5A, a pressure sensitive device 99 is mounted, for example, in the front flange portion of storage bin 88, at point A. Pressure sensitive device 99 may be, for example, a pressure-actuated switch or a pressure sensor. Device 99 is interfaced with microcomputer 92 by electrical connection 99*a*. Device 99 is designed and positioned such that seat member 89 will act on it when a child is seated on seat member 89 in chair 80. The weight of the child on seat member 89 will actuate the switch (if device 99 is a pressure-actuate switch) or be sensed by the sensor (if device 99 is a pressure sensor). Device 99 should be a bi-state or binary device such that it assumes one condition when the child is seated in chair 80 and another condition when the child leaves chair 80. In operation, microcomputer 92 receives a binary (i.e., high or low) signal from device 99 which is treated as a priority signal for a timing program in computer 92. The timing program implements a timer function for timing a pre-programmed time-out period. When the child is first seated in chair 80, device 99 senses this condition and generates a signal which is provided to computer 92 to initiate the timing program. If the child leaves chair 80 before the pre-set time-out period has elapsed, device 99 produces a signal that interrupts the timing program. Computer 92 could be programmed, for example, to resume timing the time-out period after the child is re-seated in chair 80 or to start the time-out period all over again.

Figure 7:
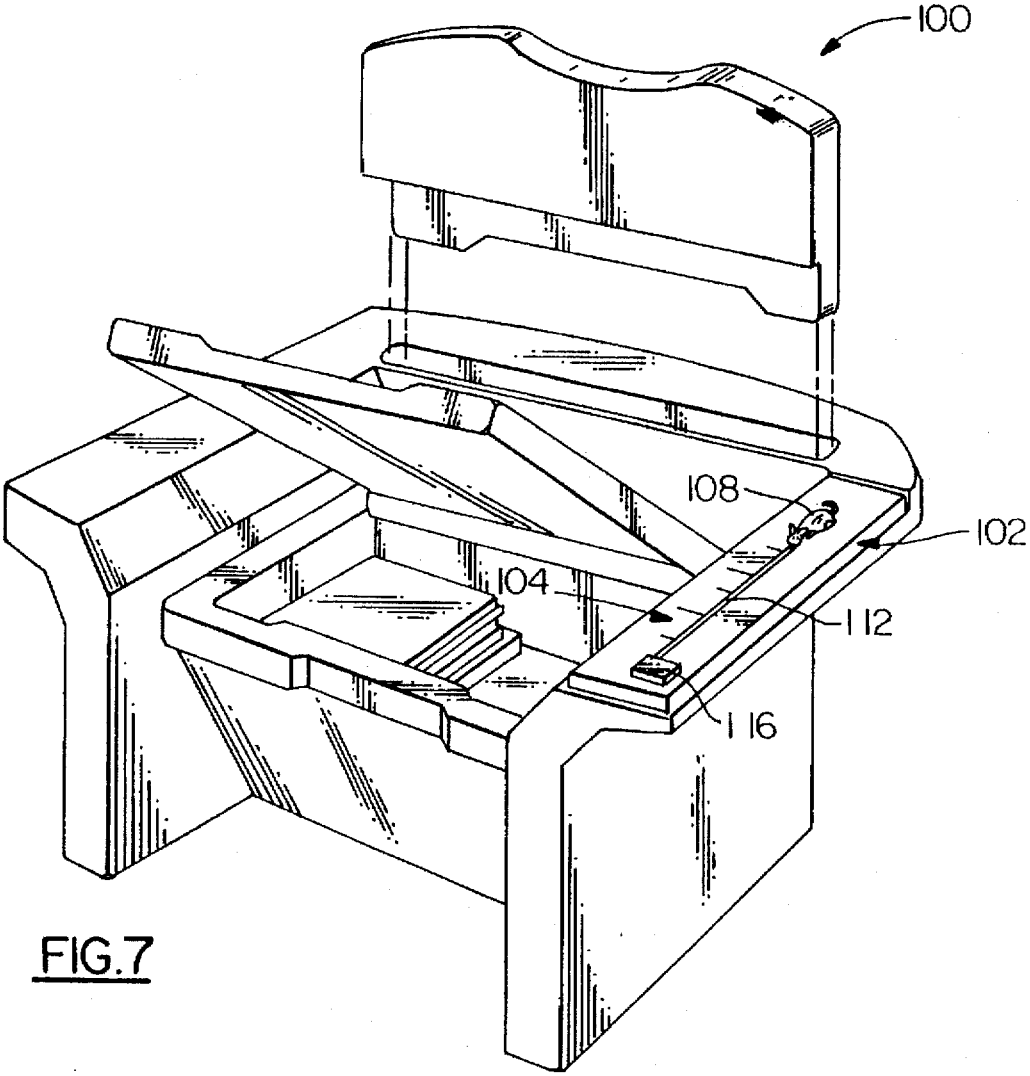
FIG. 7 is a perspective view of a third embodiment of the time-out seat of the present invention.
Figure 8:
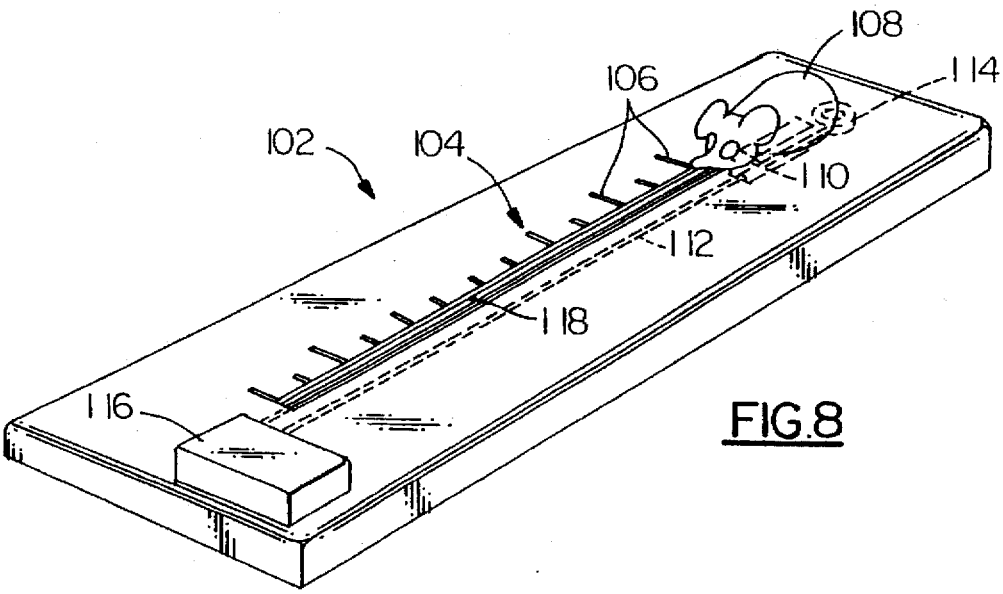
FIG. 8 is a perspective view of the timer used in the seat shown in FIG. 7.

Turning now to FIGS. 7 and 8, there is shown a third embodiment of the present invention. As shown in FIG. 7, a time-out chair 100 is constructed in generally the same manner as chair 80. However, in this embodiment, chair 100 uses a mechanical, linear timer 102, rather than a computer and electronic display to show the elapsed time in a time-out period.

As shown in FIGS. 7 and 8, linear timer 102 includes a linear scale 104 which contains scale marks 106 to indicate periods of elapsed time. For example, the space between adjacent marks 106 could be used to indicate a one minute interval. A marker 108, which can be, for example, in the form of a novelty figure such as a mouse, is slidably mounted onto a cable carriage 110 (See FIG. 8). Carriage 110 is mounted to a closed-looped or continuous cable 112, as shown in FIG. 8. Cable 112 engages a pulley 114 at one end of timer 102 and another pulley (not shown) in a geared pull box 116 at the other end of timer 102. During the operation of timer 102, marker 108 is pulled along a slot 118 by cable 112, as shown in FIG. 8.

Pull box 116 contains a spring (not shown) that is wound when marker 108 is manually pulled back away from pull box 116. Once marker 108 is pulled back and released, the spring delivers its stored energy to the pulley inside pull box 116 through a geared arrangement (not shown), causing cable 112 to advance. The advancing cable 112 pulls marker 108 along slot 118 toward pull box 116, at a constant rate, for example, one minute per segment defined by adjacent marks 106. As marker 108 reaches the end of scale 104, carriage 110 triggers a bell (not shown) to signal the end of the time-out period.

Figure 9:
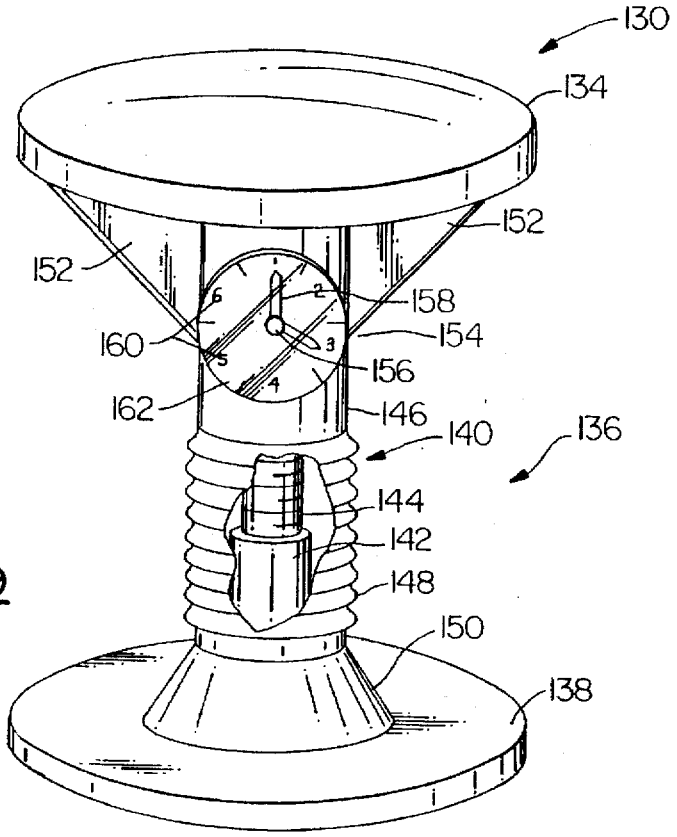
FIG. 9 is a perspective view of a fourth embodiment of the time-out seat of present invention, configured as a stool.
Figure 10:
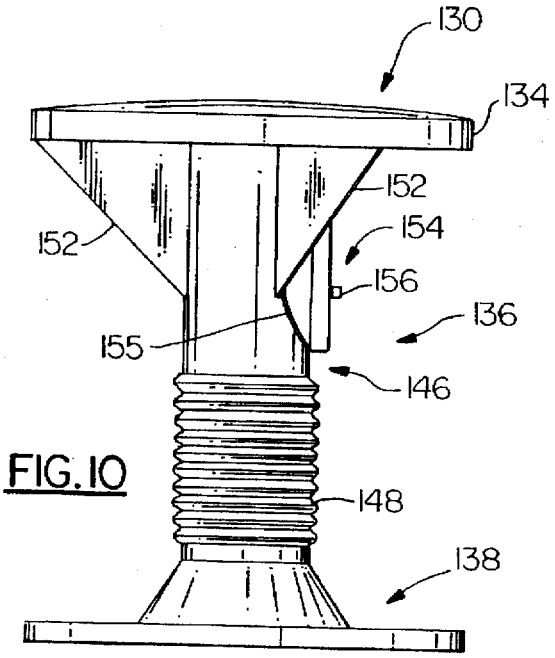
FIG. 10 is a side elevational view of the stool shown in FIG. 9.
Figure 11:
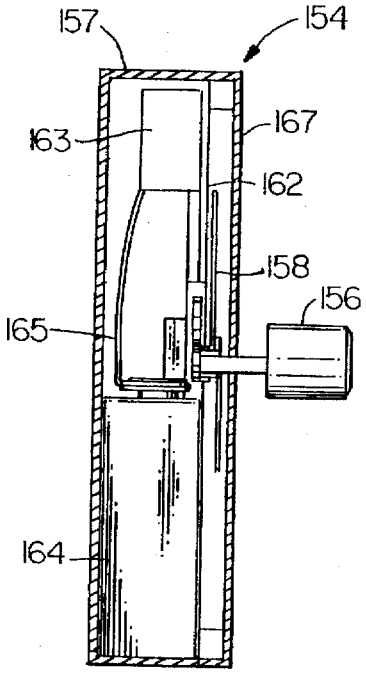
FIG. 11 is a side elevational view, with some parts shown in section, of the timer used in the stool shown in FIG. 9.

With reference to FIGS. 9–11, there is shown a fourth embodiment of the present invention. As shown in FIGS. 9 and 10, a time-out seat is configured as a stool 130. Stool 130 comprises a seat member 134 supported by a seat support structure 136. Support structure 136 includes a weighted base 138 and a support column 140. Base 138 may consist of a heavy metal disc surrounded by a plastic covering. As shown in FIG. 9, a tubular fitting 142 is fixedly mounted to the center portion of base 138 at one end and contains a threaded bore at the other end. One end of a support shaft 144 is fixedly mounted at the center of the underside of seat member 134. The other end of shaft 144 is threaded, and is dimensioned to thread into the bore of fitting 142, as shown in FIG. 9. Shaft 144 can be rotated by turning seat member 134 to adjust the height of time-out stool 130.

As shown in FIGS. 9 and 10, column 140 comprises an outer casing which includes a rigid cylindrical section 146, a flexible bellows section 148, and a rigid frusto-conical section 150. The opposing ends of bellows section 148 abut against, but are not fastened to, sections 146 and 150 respectively. Bellows 148 expands or contracts as the height of seat member 134 is adjusted. Seat member 134, section 146, and section 150 can be made from a strong reinforced plastic. Bellows 148 can be made of a flexible soft plastic. Section 146 may be integrally molded with seat member 134, along with three equally spaced triangular braces 152. Braces 152 provide support for seat member 134 by transferring some of the sitting load to rigid section 146.

With further reference to FIGS. 9–11, there is shown a timer 154 mounted by any suitable means, such as an adhesive, into a receptacle 155 contained in section 146. Timer 154 may be a mechanical timer such as timer 34, described above. As shown in FIG. 11, timer 154 is configured like a conventional oven timer. Timer 154 comprises a casing 157, a rotatably-mounted knob 156 for winding a spring (not shown) and for setting a pointer 158 to one of the minute markings 160 on a timer face 162. When the pre-set time-out period has elapsed, an electric buzzer 163 is energized. A battery 164 provides power to buzzer 163 through a wire connector 165. A transparent plastic window 167 covers both face 162 and pointer 158.

A method of disciplining a child by placing the child in a time-out seat, for a time-out period, is also contemplated by the present invention. The method comprises the steps of: (1) providing a time-out seat on which the child is to be seated during the time-out period; (2) providing a timer with the seat for timing a preset time-out period, the timer having means for setting a predetermined time-out period, means for timing the time-out period, means for indicating the time remaining in the time-out period, and means for signaling the end of the time-out period; (3) setting a time-out period on the timer as the child is seated in the time-out seat; (4) timing the time-out period with the timer; (5) constantly indicating the time remaining in the time-out period; and (6) signaling the end of the time-out period.

While the preferred embodiments of the invention have been particularly described in the specification and illustrated in the drawing, it should be understood that the invention is not so limited. Many modifications, equivalents, and adaptations of the invention will become apparent to those skilled in the art without departing from the spirit and scope of the invention as defined in the appended claims.

What we claim is:

1. A time-out seat for a child, said seat comprising:

a seat member configured and dimensioned to accept a child in a sitting position;

means for supporting said seat member in an orientation for sitting and at a predetermined height; and a timer for timing a preset time-out period, said timer including means for setting a predetermined time-out period, means for indicating the time remaining in the time-out period, and means for signaling the end of the time-out period.

2. A time-out seat as recited in claim 1, wherein said timer is supported in a position where said time indicating means is visible to a child sitting in said seat.

3. A time-out seat as recited in claim 2, wherein said seat includes an arm support containing a receptacle which is configured and dimensioned to receive and support said timer in an operative position.

4. A time-out seat as recited in claim 3, further comprising means for resisting tampering with said timer during operation thereof.

5. A time-out seat as recited in claim 3, further comprising means for marking the number of times a particular child has sat through a time-out period in said time-out seat.

6. A time-out seat as recited in claim 5, further comprising means for displaying the identity of a particular child when that child is sitting in said time-out seat.

7. A time-out seat as recited in claim 6, wherein said marking means and said displaying means are realized together in a child recording dial, and wherein said seat includes another arm support containing a receptacle which is configured and dimensioned to receive and support said recording dial in an operative position.

8. A time-out seat as recited in claim 7, wherein said child recording dial comprises a record disk and a display disk superposing said record disk; said record disk including a centrally disposed and protruding knob and an annular record surface on which the identity of a particular child can be recorded; said display disk containing a centrally disposed opening through which the knob of said record disk projects; said display disk being fixed against rotation and said record disk being assembled for rotation in the receptacle, the rotation of said record disk being effected by turning the knob of said record disk; said display disk containing a window through which the recorded identity of the particular child can be viewed when the identity is aligned with the window, the identity being aligned with the window by selectively rotating said record disk; and wherein said marking means includes a marker and numeric indicia associated with said display disk, the marker being selectively movable with respect to the indicia to provide a record of the number of time-outs the particular child has sat through.

9. A time-out seat as recited in claim 8, wherein the marker has a color associated therewith that corresponds with a color associated with the identity recorded on said record disk.

10. A time-out seat as recited in claim 1, wherein said timer is a mechanical timer, and said setting means has a knob for manually setting a predetermined time-out period.

11. A time-out seat as recited in claim 1, wherein said support means includes a storage bin, and wherein said seat member is mounted over and supported at least in part by said storage bin.

12. A time-out seat as recited in claim 1, wherein said timer is a mechanical, linear timer including a marker which is made to move along a linear path at a predetermined rate.

13. A time-out seat as recited in claim 1, wherein said seat is configured as a stool; and wherein said support means includes a base and a support column mounted to the base, said seat member being mounted to the support column.

14. A time-out seat as recited in claim 1, further comprising means for sensing the condition that a child is seated on said seat member.

15. A time-out seat recited in claim 14, further comprising means for initiating the timing of the preset time-out period in response to the sensed seated condition.

16. A time-out seat for a child, said seat comprising:

a seat member configured and dimensioned to accept a child in a sitting position;

means for supporting said seat member in an orientation for sitting and at a predetermined height; and electronic timing means for timing a preset time-out period, said timing means having a computer and an electronic display, the computer being programmable to set a predetermined time-out period, to indicate the time remaining in the time-out period on the electronic display, and to signal the end of the time-out period.

17. A time-out seat as recited in claim 16, wherein said timing means further includes a keyboard for manually setting a predetermined time-out period.

18. A time-out seat as recited in claim 17, wherein said timing means further includes an audible transducer which receives electrical signals from the computer to produce an audible signal therefrom.

19. A time-out seat as recited in claim 16, further comprising means for sensing a condition that a child is seated on said seat member, said sensing means generating a signal in response to the sensed condition and providing said signal to the computer to initiate a time-out period.

20. A method of disciplining a child by placing the child in a time-out seat for a time-out period, the method comprising the steps of:

providing a time-out seat on which the child is to be seated during the time-out period;

providing a timer with the seat for timing a preset time-out period, said timer having means for setting a predetermined time-out period, means for timing the time-out period, means for indicating the time remaining in the time-out period, and means for signaling the end of the time-out period;

setting a time-out period on said timer as the child is seated in the time-out seat;

timing the time-out period with said timer;

constantly indicating the time remaining in the time-out period; and signaling the end of the time-out period.

* * * * *